United States Patent [19]

Yarnell

[11] Patent Number: 4,602,495

[45] Date of Patent: Jul. 29, 1986

[54] DEVICE AND METHOD FOR REMOVING IRREGULARITIES IN OR ENLARGING AN UNDERGROUND DUCT

[76] Inventor: Ian R. Yarnell, Unit 106B Blackdown Industries, Haste Hill, Haslemere Surrey GU27 2HA, England

[21] Appl. No.: 673,078

[22] Filed: Nov. 19, 1984

Related U.S. Application Data

[63] Continuation of Ser. No. 504,603, Jun. 15, 1983, Pat. No. 4,487,052.

[30] Foreign Application Priority Data

Jun. 18, 1982 [GB] United Kingdom ..... 8217645

[51] Int. Cl.[4] ..... B21D 41/02

[52] U.S. Cl. ..... 72/393; 15/104.3 SN; 72/370; 72/399; 138/97; 166/55.8; 254/134.3 FT

[58] Field of Search ..... 269/48.1; 82/392; 72/370, 393, 399; 15/104.3 SN, 104.3 R; 254/134.3 FT, 134.4; 175/298; 138/97; 405/154, 156; 166/55, 55.8

[56] References Cited

U.S. PATENT DOCUMENTS

| | | | |
|---|---|---|---|
| 1,801,482 | 4/1931 | Boyton | 166/55.8 |
| 3,417,673 | 12/1968 | Bowerman | 92/241 |
| 3,528,498 | 9/1970 | Carothers | 72/370 |
| 4,309,128 | 1/1982 | Williams | 405/154 |

FOREIGN PATENT DOCUMENTS

| | | |
|---|---|---|
| 53480 | 11/1981 | European Pat. Off. . |
| 786012 | 11/1957 | United Kingdom . |
| 1261952 | 2/1972 | United Kingdom . |
| 1433932 | 4/1976 | United Kingdom . |

*Primary Examiner*—W. D. Bray

*Attorney, Agent, or Firm*—John J. Byrne; Bradford E. Kile; Kevin M. O'Brien

[57] ABSTRACT

A device for removing irregularities in or enlarging a buried duct comprises a cylindrical housing (10) corresponding approximately in diameter to the required diameter of the duct, a plurality of tapered leaf members (14) pivotally attached at their rear ends to the front of the housing, and a conical wedge (18) driven by an axial hydraulic ram (12) mounted inside the housing (10). In operation, the apparatus is drawn through the duct with the leaf members (14) in a retracted position in which they form a tapered nose portion, until an irregularity in the duct causes resistance to forward movement. The ram (12) is operated to force the leaf members outwardly against the wall of the duct to remove the irregularity. The leaf members (14) are then retracted as the apparatus is drawn forward to the next obstruction. The apparatus is particularly intended for preparing damaged sewers prior to fitting an inner, lining pipe.

16 Claims, 6 Drawing Figures

DEVICE AND METHOD FOR REMOVING IRREGULARITIES IN OR ENLARGING AN UNDERGROUND DUCT

This application is a continuation of application Ser. No. 504,603 filed June 15, 1983 now U.S. Pat. No. 4,487,052.

This invention relates to a device for profiling an underground duct, for example an underground sewer which is to be repaired by fitting an inner pipe lining.

In many of the developed industrial countries of the world, underground sewers have to a large extent reached an age at which they are in a state of severe disrepair and liable to collapse. One method of repairing sewers is to line the existing sewer pipe internally with plastics pipe sections or an expandable plastics sleeve. However, the condition of the original sewer is often such that the original earthenware pipe sections are displaced relative to each other or have already partly collapsed as shown in FIG. 1 of the accompanying drawings. In these circumstances the diameter of an inner pipe lining made up of rigid plastics pipe sections is limited over the length of sewer being repaired so that determined by the worst irregularity in that length. The result is that the flow capacity of the repaired sewer may be considerably reduced. Attempts have been made to hammer out the irregularities with a remotely controlled machine, but this has proved difficult to control and can worsen the state of collapse.

It is an object of this invention to provide apparatus able largely to correct the irregularities in an existing sewer in a relatively controllable and reliable manner.

According to a first aspect of this invention, a device for removing irregularities in or enlarging a buried duct comprises: a base member shaped to engage the wall of the duct; a plurality of leaf members in the region of an end of the base member and arranged substantially symmetrically around a central longitudinal axis, each leaf member being mounted for movement transversely with respect to the longitudinal axis; a longitudinally mounted ram; and means connecting the ram to the leaf members so that operation of the ram causes the leaf members to move outwardly away from the axis to bear against the wall of the duct. In a preferred embodiment of the invention, the leaf members are pivotable between a retracted position in which their outer surfaces together form a tapered nose portion, and an expanded position in which their outer surfaces together form a substantially cylindrical surface corresponding to the required size of the duct. The connecting means which is preferably in the form of a cone with guide rails for the leaf members, is movable hydraulically by the ram, which is mounted in the base member. According to the second aspect of the invention, there is provided a method of removing irregularities in or enlarging a buried duct by remote control, comprising: (i) providing a remotely controlled device inside the duct, the device comprising a base member, a plurality of leaf members arranged symmetrically around a longitudinal axis of the device and coupled to the base member, and expander means longitudinally movable relative to the base member for moving the leaf members between a retracted position in which they form a tapered nose portion and an expanded position in which they form a substantially cylindrical surface corresponding to the required size of the duct; (ii) providing means for remotely controlling movement of the wedge and means for driving the device along the duct; (iii) driving the device through the duct with the leaf members leading and in their retracted position; (iv) when resistance to movement of the device reaches a given level, remotely expanding the leaf members to push the wall of the duct outwardly to reduce the resistance to movement; (v) returning the leaf members to their retracted position, and repeating steps (iii) and (iv) until the required length of duct has been transversed. The device may be driven through the duct by repeatedly operating a hydraulic ram at an accessible location, the ram being alternately connected and disconnected during each operating stroke to a chain or wire connected to the device through the duct. In this way the wall portion is forced into the material surrounding the duct until the internal diameter of the duct at that location corresponds generally to the original diameter, or, when required, to a larger diameter determined by the diameter of the device. Depending on the nature of the duct and the material surrounding it, it may be possible to enlarge or profile much of the duct merely by drawing the device through the duct with sufficient force. However, in most cases it is necessary periodically or continuously to expand the leaf members for forward movement to be maintained.

The invention will now be described by way of example with reference to FIGS. 1 to 6 of the drawings in which.

Figure 1:
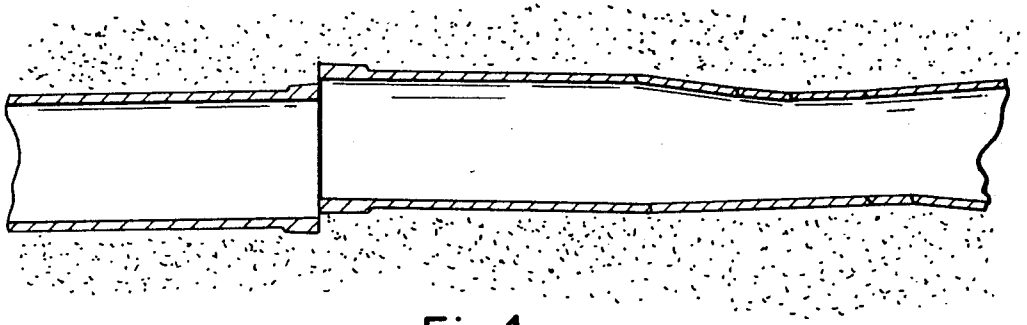
FIG. 1 is a perspective view of a broken duct.
Figure 2:
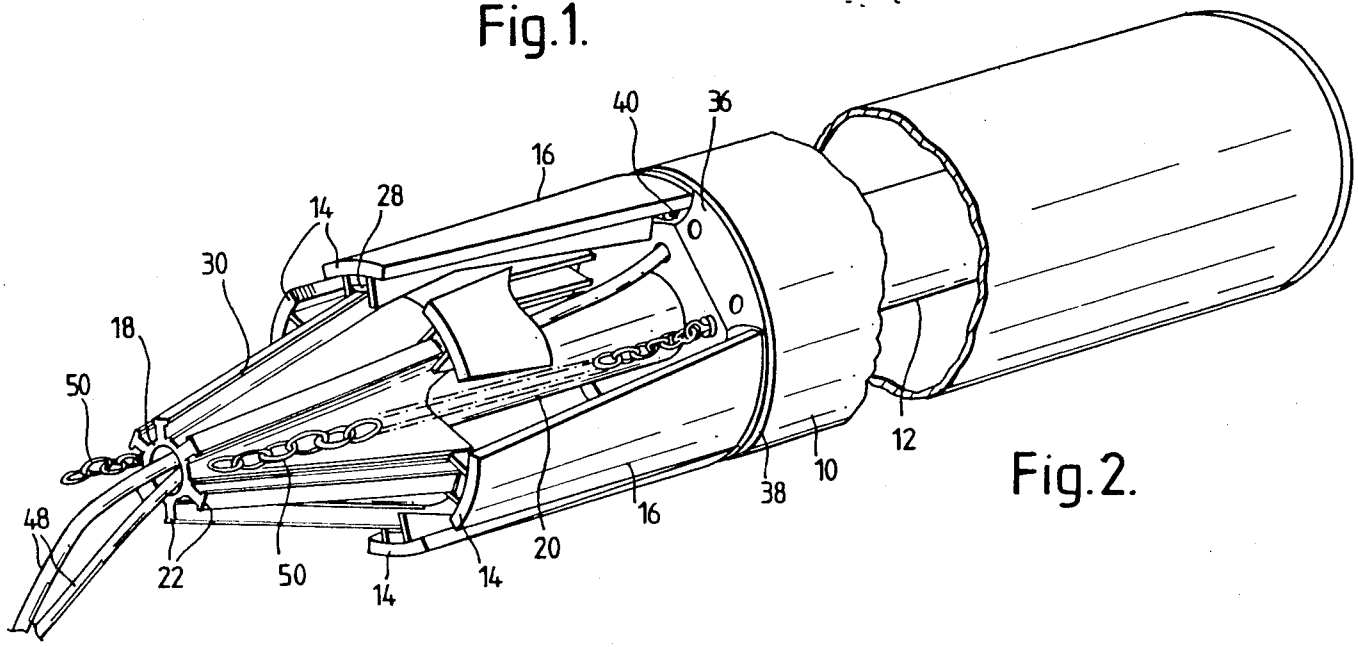
FIG. 2 is a perspective view of a device in accordance with the invention with leaf members in an expanded position.
Figure 3:
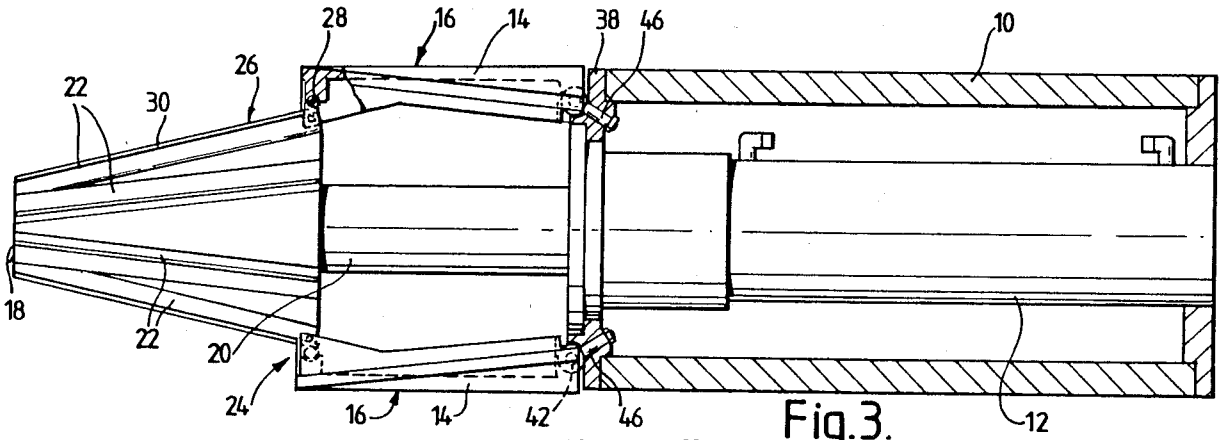
FIG. 3 is a cut away side elevation of the device with a ram housing shown in section, and with leaf members again in their expanded position.
Figure 4:
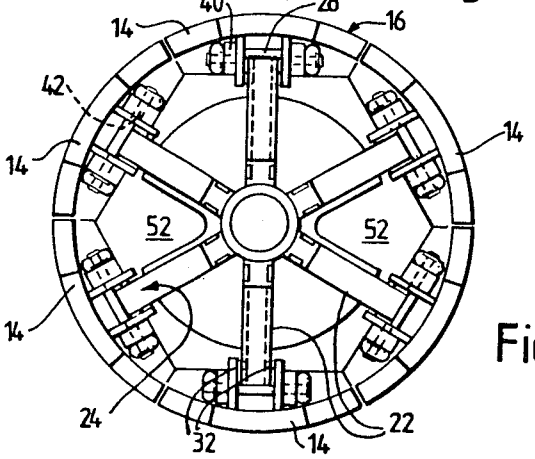
FIG. 4 is an end elevation of the device.
Figure 5:
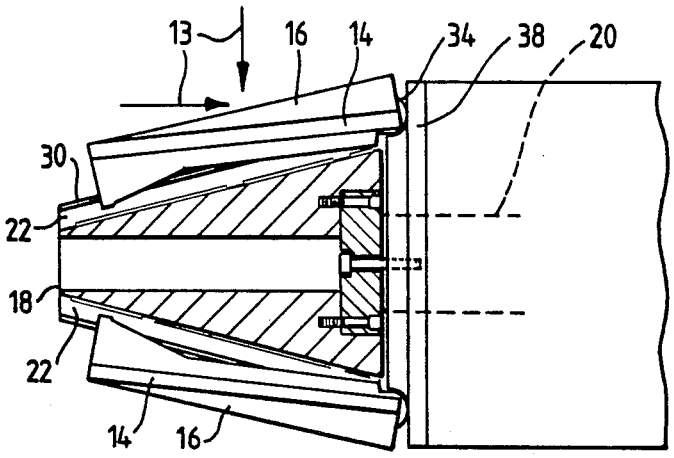
FIG. 5 is a side elevation of part of the device, showing the leaf members in their retracted position.

Referring to FIGS. 2 to 5 of the drawings, the preferred embodiment of the invention comprises a cylindrical base member 10 which acts as a housing for a longitudinally mounted double-acting ram 12. The diameter of the base member 10 corresponds approximately to the required internal diameter of the duct so that the device can be positioned in the duct with its longitudinal axis substantially coincident with the axis of the duct. Attached to front end of the base member 10 are six tapered leaf members 14 arranged in annular fashion symmetrically around the longitudinal axis. Each leaf member 14 has a part conical outer surface 16 and is pivotally mounted at its rear, proximal end to the base member 14 so that it is pivotable about a respective transverse axis. The transverse axes together form a regular polygon perpendicular to the longitudinal axis, in this case a hexagon. A generally conical expander wedge 18 is mounted on the piston rod 20 of the ram 12 for moving the leaf members 14 between a first, retracted position (FIG. 5) in which the leaf members 14 form a conical nose portion, and a second, expanded position in which their outer surfaces 16 constitute a generally cylindrical outer shell forming a continuation of the other surface of the base member.

Guide rails 22 on the wedge 18 locate in channels 24 formed in the undersides of the leaf members 14, and the outer surfaces 26 of the rails are engaged by rollers 28 trapped in recesses at the front ends of the leaf members 14. Each rail 22 has a flange 30 so that a pair of studs 32 (FIG. 4) fixed in each leaf member 14 and located under the flange retains the front end of the leaf member on the rail 22. It will be appreciated that when the leaf members 14 are under load, as is the case when the device is being drawn through the undersize or collapsed duct, or when the ram 12 is operated to force the duct wall outward, considerable inwardly and rearwardly directed forces 13 are exerted on the leaf members 14, and in turn on the base member 10 through the pivoted connections at the rear ends of the leaf members 14. These forces are transmitted between a transverse, convex, part-cylindrical bearing surface 34 (FIG. 5) on the rear end of each leaf member 14, and a concave part-cylindrical bearing surface (FIG. 2) of corresponding radius machined in an annular end portion 38 of the base member 10.

The end portion 38 has six such bearing surfaces 36 arranged in a hexagon around its perimeter. The leaf member bearing surface 36 is provided by a transverse steel bar 40 (FIGS. 2 and 4) welded to the rear end of the respective leaf member. For each leaf member 14 two pins 42 (FIG. 2 and FIG. 3) received in a bolt bored through the bar 40, locate in the eyes of two inclined bolts 46 (FIG. 3) secured in the end position 38 of the base member 10. The pins 42 serve only to retain the leaf member on the base member 10; they are a loose fit in the bolt eyes, the compression forces under load being transmitted through the bearing surfaces referred to above.

Figure 6:
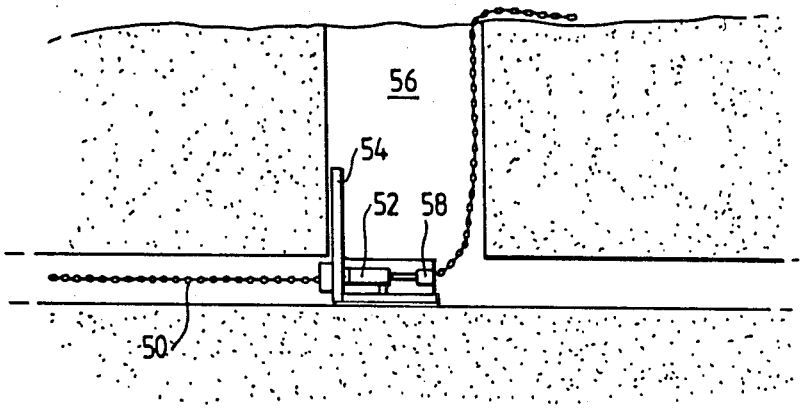
FIG. 6 is a diagrammatic section showing means for applying a pulling force to a chain at one end of an underground duct.

Hydraulic supply pipes 48 for the ram 12 pass through the end portion 38 of the base member 10 and through the interior of the wedge 18. Chains 50 for drawing the device through the duct are attached to the base member 10 and pass through a pair of recesses 52 (FIG. 4) in the outer surface of the wedge 18, although in an alternative embodiment (not shown) the chains may be attached instead to the front end of the wedge 18. Referring to FIG. 6, the chains 50 are fed along the duct to a drive ram 52 mounted in a stationary frame 54 bearing against the side of, for example, a manhole 56. To pull the apparatus through the duct, the ram 52 is reciprocated back and forth repeatedly, the piston rod of the ram 52 being alternately connected and disconnected with the chain 50. A ratchet device 58 holds the chain 50 in tension between each stroke of the ram 52. A pair of rams may be used in place of the single ram 52.

In operation the remotely controllable device shown in FIGS. 2 to 5 and the drive mechanism shown in FIG. 6 act together as follows. The remote controllable device is positioned in the duct at the beginning of the stretch to be traversed and chains 50 are passed through the duct together with the hydraulic supply pipes 48 to the manhole 56. The chains 50 are secured to the drive mechanism and the pipes 48 connected to external control means (not shown) in the vicinity of the manhole. With the leaf members 14 in the retracted position, the remotely controllable device is drawn along the duct, nose portion leading, so that the walls of the duct are forced into the surrounding soil wherever they intrude inside the diameter of the base member 10. Depending on the nature of the duct and the soil around it, the pulling force which can be exerted by the ram 52 and the chain 50 may be insufficient to draw the device past certain locations. This condition is sensed at the control location by monitoring movement of the chains 50 or the fluid pressure in the ram 52. To remove the obstruction, a significantly larger compression force can now be applied to the wall of the duct by operating the ram 12. By maintaining tension in the chains 50, the remotely controllable device will begin to move forward again when the leaf members 14 are retracted. Thus, by a continuation of pulling and expansion steps the device is drawn through the duct eventually to the manhole 56, leaving a passage of a diameter sufficient to accept a plastics lining of required diameter. Conveniently, the device may be used to draw pipe lining sections behind it as it progresses through the duct.

To allow fluids to continue to pass through the duct when the remotely controllable device is being used, the device may include a passage connecting the front end to the rear end. In this case, the ram 12 may be replaced by a plurality of rams spaced around the axis, leaving a clear axial passage through the device.

I claim:

1. A device for removing irregularities in or enlarging an underground duct, comprising a rear portion having a generally cylindrical outer surface corresponding substantially to the required diameter of the duct, a segmental front portion including a set of leaf members which are movable transversely relative to a longitudinal axis of the device between a retracted configuration and an expanded configuration, the leaf members having traversely and longitudinally extending outer surface portions collectively defining an expandable segmented outer surface substantially encircling the axis such that in their retracted configuration the members are capable of penetrating a duct portion of a diameter less than the said required diameter, and in their expanded configuration define an outer envelope of dimensions corresponding substantially to the required dimensions of the duct, and drive means for moving the leaf members between their retracted and expanded configurations.

2. A device for removing irregularities in or enlarging an underground duct, comprising a rear portion having a generally cylindrical outer surface corresponding substantially to the required diameter of the duct, a segmental front portion including a set of leaf members which are movable transversely relative to a longitudinal axis of the device between a retracted configuration and an expanded configuration, the leaf members having outer surface portions together defining a variable outer envelope such that in their retracted configuration the members are capable of penetrating a duct portion of a diameter less than the said required diameter, and in their expanded configuration define an outer envelope of dimensions corresponding substantially to the required dimensions of the duct, and drive means for moving the leaf members between their retracted and expanded configurations, wherein each of the set of leaf members has a curved, radially directed outer surface portion such that the leaf members, in their expanded configuration, collectively define a generally cylindrical outer envelope.

3. A device according to claim 2, wherein each of the set of leaf members has a front end and a rear end, the rear ends of the leaf members being pivotally connected to the rear portion for pivotal movement about respective transverse axes, and wherein the outer surface portions of the leaf members collectively define a generally conical outer envelope when in the retracted configuration.

4. A device according to claim 3 wherein the drive means comprises internal fluid driven ram means.

5. A device according to claim 3, wherein the drive means comprises a longitudinally mounted ram coupled to a means attached to the front ends of the leaf members for converting longitudinal movements of the ram into radial movements of the said front ends relative to the longitudinal axis of the device.

6. A remotely controllable device for removing irregularities in or enlarging an underground duct, comprising a base member, a set of leaf members arranged symmetrically around a central longitudinal axis of the device and together defining an outer surface portion of the device, each leaf member of the set of leaf members being connected to the base member so as to be movable relative to the base member transversely with respect to the longitudinal axis, and drive means coupled to the leaf members for moving them together outwardly from a retracted configuration to an expanded configuration in which they define collectively a generally cylindrical outer surface portion corresponding in diameter to the required diameter of the duct, wherein each of the set of leaf members has a front end and a rear end, the rear end being pivotally connected to the base member such that the front end is movable towards or away from the longitudinal axis, the arrangement of the leaf members, on the case member being such that in their retracted configuration they form an outer envelope which tapers from the rear ends towards the front ends of the members.

7. A device according to claim 6, wherein the drive means comprises a fluid driven ram mounted longitudinally in the base member.

8. A device according to claim 7, including means coupling a movable portion of the ram to the front ends of the leaf members for moving said front ends substantially radially relative to the longitudinal axis in response to longitudinal movements of said movable portion.

9. A device according to claim 8, wherein said coupling means comprises a tapered expander member secured to said movable portion of the ram, the expander member having a plurality of longitudinal guides with bearing surfaces lying in a notional frusto-conical surface centred on the longitudinal axis for supporting the front ends of the leaf members.

10. A method of removing irregularities in or enlarging a buried duct by remote control including the steps of:

(i) placing inside the duct an apparatus comprising a front part including a plurality of leaf members arranged symmetrically about a longitudinal axis of the apparatus and movable transversely relative to the axis between a retracted configuration and an expanded configuration, and a generally cylindrical rear part coupled to the front part and having a diameter equal to or approaching that of the required diameter of the duct;

(ii) providing means for remotely controlling movement of the leaf members;

(iii) providing means for drawing the apparatus through the duct;

(iv) moving the apparatus forwardly in the duct with the leaf members in their retracted configuration to a position in which the said front part penetrates a part of the duct having a diameter less than the required diameter;

(v) driving the leaf members into their expanded configuration thereby to push the wall of the duct outwardly to form an expanded duct portion having substantially the required diameter;

(vi) retracting the leaf members; and (vii) drawing the apparatus forward so that the rear part enters the said expanded duct portion.

11. A method according to claim 10, in which the apparatus is drawn through the duct by repeatedly operating a hydraulic ram at an accessible location, the ram being alternately connected and disconnected during each operating stroke to a chain or wire connected to the apparatus through the duct.

12. A remotely controllable device for removing irregularities in or enlarging an underground duct, comprising a base member, a set of leaf members arranged symmetrically around a central longitudinal axis of the device and together defining segmented outer surface portion of the device, each leaf member of the set of leaf members being connected to the base member so as to be movable relative to the base member transversely with respect to the longitudinal axis, and drive means coupled to the leaf members for moving them together outwardly from a retracted configuration to an expanded configuration in which they define collectively a generally cylindrical segmented outer surface portion corresponding in diameter to the required diameter of the duct.

13. A remotely controllable device for removing irregularities in or enlarging an underground duct, comprising:

a base member shaped to engage the wall of the duct;

a plurality of leaf members in the region of an end of the base member and arranged substantially symmetrically around a central longitudinal axis, each leaf member having an outwardly directed transversely and longitudinally extending contact surface;

internally mounted fluid driven ram means; and means connecting said ram means to the leaf members so that operation of said ram means causes the leaf members to move outwardly away from the axis thereby to bring said contact surfaces to bear against the wall of the duct.

14. A device according to claim 13, wherein each of said plurality of leaf members has a front end and a rear end, and each is pivotally mounted at its rear end on the base member for pivotal movement about a respective transverse axis, said connecting means being coupled to said front ends of said leaf members and arranged to impart a substantially radial movement to each of said front ends on operation of said ram means.

15. A device for removing irregularities in or enlarging an underground duct by progressive movement through the duct under remote control, wherein the device comprises a leading portion and a trailing portion, the trailing portion having a cross-section substantially in accordance with the required diameter of the duct, and the leading portion comprising a set of leaf members which are movable transversely with respect to a central longitudinal axis of the device between a retracted configuration and an expanded configuration, and which have outer surfaces collectively defining an outer envelope of variable dimensions, the device further comprising drive means for urging the leaf members outwardly from the longitudinal axis to push out the sides of the duct thereby to create an unobstructed duct portion shaped to receive the trailing portion of the device when the device is subsequently moved forward in the duct.

16. A device according to claim 15, wherein the outer surface of each leaf member is substantially part cylindrical.

* * * * *